United States Patent [19]

Bova

[11] 4,212,335

[45] Jul. 15, 1980

[54] WATERBED FILLING UNIT

[76] Inventor: Anthony J. Bova, P.O. Box 4175, Stockton, Calif. 95204

[21] Appl. No.: 881,792

[22] Filed: Feb. 27, 1978

[51] Int. Cl.[2] ..... B65B 3/04; F16L 35/00

[52] U.S. Cl. ..... 141/382; 141/384; 285/332; 285/386

[58] Field of Search ..... 15/369; 141/313, 382-386; 285/174, 175, 354, 386, 332

[56] References Cited

U.S. PATENT DOCUMENTS

| | | | |
|---|---|---|---|
| 2,417,350 | 3/1947 | Conroy | 285/386 X |
| 3,494,643 | 2/1970 | Longshaw et al. | 285/365 |
| 3,616,866 | 11/1971 | Verheul | 285/332 X |
| 3,797,538 | 3/1974 | Mollura | 141/313 |
| 3,879,064 | 4/1975 | Lagarelli | 285/386 X |

*Primary Examiner*—Frederick R. Schmidt
*Attorney, Agent, or Firm*—Roger B. Webster

[57] ABSTRACT

The waterbed filling unit, embodies a tapered, water-delivery tube adapted for insertion into the male-threaded filler neck of a waterbed in jam relation, the then outer end of the tube having a fixed, female-threaded fitting thereon adapted for coupling with the male-threaded fitting of a garden hose, and a female-threaded, nut-type fitting rotatably surrounding the tube intermediate its ends and adapted for coupling with said male-threaded filler neck; there being an annular, external, stop flange on the tube within the confines of said rotatable fitting, and the latter clamping said stop flange against the upper end of the filler neck whereby to maintain such jam relation and prevent separation of the tube from the filler neck.

1 Claim, 4 Drawing Figures

FIG-2
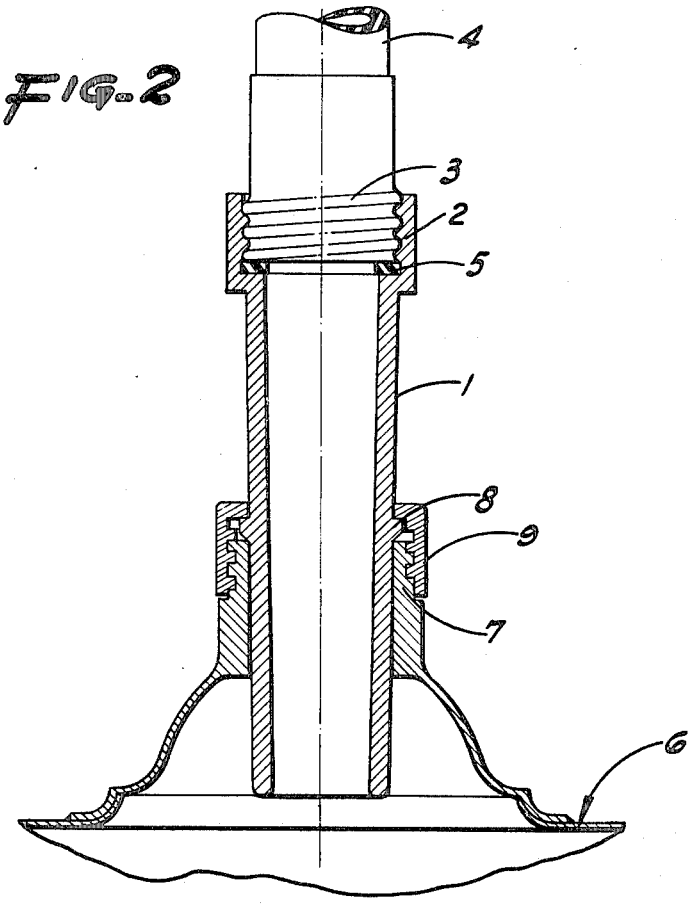
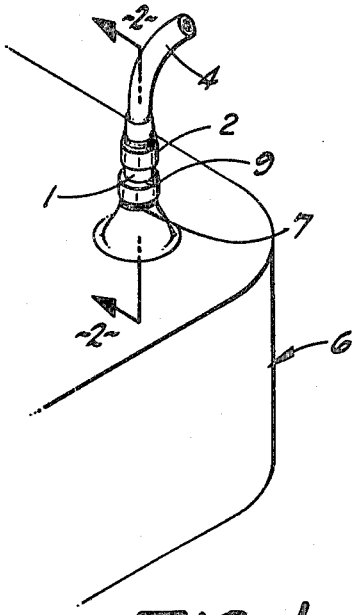
FIG-1
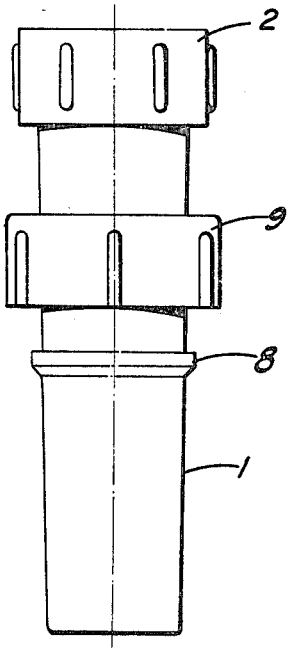
FIG-3
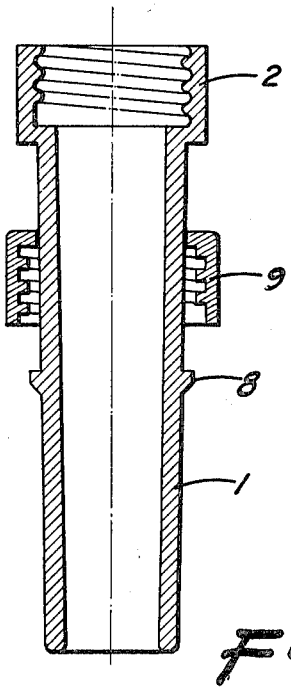
FIG-4

WATERBED FILLING UNIT

BACKGROUND OF THE INVENTION

1. Field of the invention

Waterbeds are conventionally provided with a male-threaded filler neck having a closure cap threaded thereon; such cap being removed for the purpose of introducing water into the waterbed from a conventional garden hose having a male-threaded fitting on its outer end. As both the filler neck on the waterbed and the outer end fitting on the garden hose are male-threaded, a problem is presented in that direct coupling therebetween cannot be accomplished. The present invention solves such problem by providing a coupling unit for interposition between and connection with said male-threaded fittings.

2. The prior Art

U.S. Pat. Nos. 3,494,643 and 3,797,538 represent the most relevant prior art known to applicant.

The above prior art—considered singly or together—does not anticipate, nor suggest as obvious, the particular structure of the herein-claimed waterbed filling unit, and applicant has no knowledge of any prior art disclosing such particular structure.

SUMMARY OF THE INVENTION

The present invention provides, as a major object, a waterbed filling unit—for interposition between and connection with the male-threaded filler neck of a waterbed and the male-threaded fitting on the outer end of a garden hose—which embodies a tapered, water-delivery tube adapted for insertion into said male-threaded filler neck in jam relation, the then outer end of the tube having a fixed, female-threaded fitting thereon adapted for coupling with said male-threaded fitting of the garden hose, and a female-threaded, nut-type fitting rotatably surrounding the tube intermediate its ends and adapted for coupling with said male-threaded filler neck; there being an annular, external, stop flange on the tube within the confines of said rotatable fitting, and the latter clamping said stop flange against the upper end of the filler neck whereby to maintain such jam relation and prevent separation of the tube from the filler neck.

The present invention provides, as a further object, a waterbed filling unit which is designed for ease and economy of manufacture.

The present invention provides, as a still further object, a practical, reliable, and durable waterbed filling unit, and one which is exceedingly effective for the purpose for which it is designed.

BRIEF DESCRIPTION OF THE DRAWINGS

FIG. 1 is a view showing the waterbed filling unit as in use.

FIG. 2 is an enlarged sectional elevation taken substantially on line 2—2 of FIG. 1.

FIG. 3 is an elevation of the waterbed filling unit detached.

FIG. 4 is a sectional elevation of the same.

DESCRIPTION OF THE PREFERRED EMBODIMENT

Referring now more particularly to the drawings and to the characters of reference marked thereon, the waterbed filling unit, of the present invention, comprises—preferably of plastic—a long-tapered water-deliver tube 1 having a fixed, female-threaded head or fitting 2 formed on the outer end of such tube; such fitting 2 being adapted for threaded coupling with the male-threaded fitting 3 on the outer end of a conventional garden hose 4. A common, leak-preventing hose washer 5 is engaged in the fitting 2 by the fitting 3.

To fill a waterbed 6 with water, the tapered tube 1—after coupling of fittings 2 and 3—is inserted in telescopic, jam relation into the upstanding, exteriorly male-threaded but internally smooth filler neck 7; the point of jamming being intermediate the ends of such tube. The tube 1 and filler neck 7 are then interconnected in the following manner:

Immediately above the horizontal plane occupied by the upper end of the filler neck 7, the tube 1 is formed with an external, annular stop flange 8 which is encompassed from above by a female-threaded, nut-type fitting 9; the fitting 9 being threaded on the filler neck 7 until tight, and at which time the stop flange 8 is forcefully clamped against the upper end of said filler neck whereby to maintain the aforesaid jam relation of the tube 1 in filler neck 7 and prevent separation of such parts.

With the described waterbed filling unit constructed and coupled as described, a waterbed can be filled expeditiously and without undesirable external leakage; the construction of the unit being such that it can be easily and quickly attached or detached.

It may also be noted that the stop flange serves the additional purpose of preventing the nut-type fitting 9 from sliding down to and accidentally escaping from the lower end of tube 1 when the unit is not in use, or when being manipulated for coupling with, or detachment from, the filler neck 7.

From the foregoing description, it will be readily seen that there has been produced such a waterbed filling unit as substantially fulfills the objects of the invention as set forth herein.

While this specification sets forth in detail the present and preferred construction of the waterbed filling unit, still in practice such deviations from such detail may be resorted to as do not form a departure from the spirit of the invention as defined by the appended claims.

I claim:

1. A waterbed filling unit—for interposition between, and connection with, the exteriorly male-threaded filler neck of a waterbed and the male-threaded fitting on the outer end of a garden hose—comprising a water-delivery tube for telescopic insertion into said male-threaded filler neck, a female-threaded fitting on the then outer end of the tube for coupling with said male-threaded fitting of the garden hose, a nut-type fitting rotatably surrounding the tube intermediate its ends for coupling with said male-threaded neck, an external annular stop flange on the tube intermediate its ends and encompassed by the nut-type fitting, the stop flange—when such nut-type fitting is threaded tight on the filler neck—being clamped against the upper end of the latter, the water-delivery tube being elongated between the stop flange and the inner end of such tube and projecting inwardly beyond the nut-type fitting, and said elongated portion of the tube being long-tapered and telescopically internally engaging in jam relation in the filler neck; the nut-type fitting, as threaded tight on the filler neck and with the stop flange as then clamped against the upper end of the filler neck, maintaining such jam relation of the elongated portion of the tube in the filler neck.

* * * * *